US012630270B2

(12) United States Patent
Oshima

(10) Patent No.: US 12,630,270 B2
(45) Date of Patent: May 19, 2026

(54) DISPLAY DEVICE AND OUTBOARD MOTOR

(71) Applicant: HONDA MOTOR CO., LTD., Tokyo (JP)

(72) Inventor: Mio Oshima, Saitama (JP)

(73) Assignee: HONDA MOTOR CO., LTD, Tokyo (JP)

( * ) Notice: Subject to any disclaimer, the term of this patent is extended or adjusted under 35 U.S.C. 154(b) by 187 days.

(21) Appl. No.: 18/192,662

(22) Filed: Mar. 30, 2023

(65) Prior Publication Data

US 2024/0326960 A1 Oct. 3, 2024

(51) Int. Cl.

| | |
|---|---|
| ***B63B 49/00*** | (2006.01) |
| ***B63B 79/40*** | (2020.01) |
| ***B63H 20/12*** | (2006.01) |
| ***B63H 21/21*** | (2006.01) |

(52) U.S. Cl.

CPC ..... *B63B 49/00* (2013.01); *B63B 79/40* (2020.01); *B63H 20/12* (2013.01); *B63H 21/213* (2013.01); *B63H 2021/216* (2013.01)

(58) Field of Classification Search

CPC ..... B63B 49/00; B63B 79/40; B63H 20/12; B63H 21/213; B63H 2021/216

See application file for complete search history.

(56) References Cited

U.S. PATENT DOCUMENTS

| | | | | |
|---|---|---|---|---|
| 8,296,001 | B1 * | 10/2012 | Kabel | G08G 3/02 701/410 |
| 9,038,560 | B1 * | 5/2015 | Brendel | B63B 34/75 114/284 |
| 2009/0264032 | A1 * | 10/2009 | Kubota | B63H 21/22 440/87 |
| 2015/0120102 | A1 * | 4/2015 | Hosokawa | G01C 21/203 701/21 |
| 2021/0245853 | A1 | 8/2021 | Yamaguchi et al. | |
| 2023/0078851 | A1 * | 3/2023 | Behrendt | G06F 3/0486 701/21 |
| 2023/0192263 | A1 * | 6/2023 | Ikegaya | B63H 25/42 701/21 |

FOREIGN PATENT DOCUMENTS

JP 2021126954 A 9/2021

* cited by examiner

*Primary Examiner* — Naeem Taslim Alam

(74) *Attorney, Agent, or Firm* — CKC & PARTNERS CO., LLC

(57) ABSTRACT

Provided is a display device with which it is possible to indicate whether a direction of movement according to operation by a pilot and the actual direction of movement of a watercraft are in agreement. The display device is provided with a direction-of-movement indicator 133 that shows an indication related to the direction of movement of a watercraft. The direction-of-movement indicator 133 shows the indication in a first mode and a second mode, the first mode being a display mode displaying that there is a disagreement between a specified direction of movement specified by means of a shift switch 123 and the actual direction of movement, the second mode being a display mode displaying that the specified direction of movement and the actual direction of movement are in agreement.

12 Claims, 11 Drawing Sheets

DISPLAY DEVICE AND OUTBOARD MOTOR

BACKGROUND OF THE INVENTION

Field of the Invention

The present disclosure relates to a display device and an outboard motor with which a state of movement of a watercraft is indicated.

Related Art

In a case of a watercraft, when a pilot performs an operation, there is a delay before the watercraft actually moves in response to the content of the operation by the pilot. For example, if a reverse operation is performed while the watercraft is moving forward, the watercraft cannot move in reverse instantaneously, and instead the watercraft gradually slows down and stops before beginning to move in reverse. More specifically, the flow of the process for switching from moving forward to moving in reverse is as follows. First, for example, the pilot presses a shift switch to specify switching to moving in reverse. Next, a screw propeller actually switches from rotation for moving forward (forward rotation) to rotation for moving in reverse (reverse rotation). Next, the direction of movement of the hull switches from moving forward to moving in reverse. Thereafter, the speed of the vessel undergoes an acceleration process and increases to reach the speed desired by the pilot.

Outboard motors normally are not equipped with brakes, and therefore it takes time for the rotation speed of the screw propeller to decrease to a low speed. If the prime mover is an engine (internal combustion engine (ICE)), the deceleration of the screw propeller is relatively fast due to the weight of the engine itself, but if the prime mover is an electric motor in particular, it takes a longer time until the rotation speed of the screw propeller decreases to a low speed. Moreover, even after the screw propeller started rotating in reverse, the vessel continues to move forward due to inertia despite the resistance of the water, and it takes time until the vessel actually switches from moving forward to moving in reverse.

In the related art, a configuration is known in which, in an outboard motor that switches between moving forward and moving in reverse by means of a shift switch, the pilot is informed by vibration, light, sound, or the like when the shift switch is operated to switch to moving in reverse (see Japanese Unexamined Patent Application, Publication No. 2021-126954, for example).

Patent Document 1: Japanese Unexamined Patent Application, Publication No. 2021-126954

SUMMARY OF THE INVENTION

However, in the case of a device that informs the pilot of a switching operation of the shift switch like in the related art, a situation occurs in which even though the pilot is informed of the switch to moving in reverse, the vessel is still moving forward due to the time actually taking to switch the direction of movement of the vessel. In such a situation, the pilot may be confused. That is, when the pilot performs a switching operation, there may be a disagreement between the direction of movement (backward) announced in response to the switch and the actual direction of movement (forward) of the watercraft, and in some cases, this disagreement may create a feeling of discomfort or confusion in the pilot. In particular, when there is a quay or other stationary land-based object near the watercraft, it is easy for the pilot to sense the actual direction of movement. In contrast, when there is no stationary land-based object near the watercraft, it is difficult for the pilot to sense the direction of movement of the watercraft. Consequently, in such situations, the pilot may be unable to correctly determine the actual direction of movement of the watercraft, which is likely to create a feeling of discomfort in the pilot.

An object of the present disclosure is to provide a display device and an outboard motor with which it is possible to indicate whether a direction of movement according to operation by the pilot and the actual direction of movement of the watercraft are in agreement.

The present disclosure is to achieve the above object through solutions described below. Note that although the following description contains reference signs corresponding to an embodiment of the present disclosure to facilitate understanding, the present disclosure is not limited thereto.

A first aspect of the disclosure is directed to a display device (111, 130) for use on a watercraft (200) to display a state of movement of the watercraft (200) on a display (130). The display device (111, 130) includes a display controller (111) that controls indication on the display (130). The display controller (111) acquires a specified direction of movement, an actual direction of movement, and an actual speed, the specified direction of movement being a specified direction in which the watercraft (200) is to move, the actual direction of movement being a direction in which the watercraft (200) actually moves, and the actual speed being a speed at which the watercraft (200) actually moves. The display (130) has a direction-of-movement indicator (133, 134) that is controlled by the display controller (111) to show an indication related to a direction of movement of the watercraft (200). The direction-of-movement indicator (133, 134) shows the indication in a first mode and a second mode, the first mode being a display mode displaying that there is a disagreement between the specified direction of movement and the actual direction of movement and the second mode being a display mode displaying that the specified direction of movement and the actual direction of movement are in agreement.

According to the second aspect of the disclosure, in the display device (111, 130) as described in the first aspect, the direction-of-movement indicator (133, 134) shows the indication further in a third mode which is a display mode displaying that a specified speed based on an operation by a user and the actual speed are in agreement.

According to the third aspect of the disclosure, in the display device (111, 130) as described in the second aspect, in the first mode, the direction-of-movement indicator (133, 134) blinks, in the second mode, the direction-of-movement indicator (133, 134) blinks in a longer cycle than in the first mode, and in the third mode, the direction-of-movement indicator (133, 134) is steadily on without blinking.

According to the fourth aspect of the disclosure, in the display device (111, 130) as described in the third aspect, a cycle in which the direction-of-movement indicator (133, 134) blinks in the first mode changes in accordance with a degree of disagreement between the specified direction of movement and the actual direction of movement, and approaches a cycle in which the direction-of-movement indicator (133, 134) blinks in the second mode as the specified direction of movement and the actual direction of movement approach agreement.

According to the fifth aspect of the disclosure, in the display device (111, 130) as described in the third or the fourth aspect, brightness of the direction-of-movement indicator (133, 134) is higher in the second mode than in the first mode, and is higher in the third mode than in the second mode.

According to the sixth aspect of the disclosure, in the display device (111, 130) as described in the second aspect, the direction-of-movement indicator (134) includes a forward indicator (134*a*) to indicate moving forward and a reverse indicator (134*c*) to indicate moving in reverse, in the first mode, the forward indicator (134*a*) and the reverse indicator (134*c*) both blink, and one of the forward indicator (134*a*) and the reverse indicator (134*c*) that corresponds to the specified direction of movement is displayed brighter than an other that does not correspond to the specified direction of movement, in the second mode, only one of the forward indicator (134*a*) and the reverse indicator (134*c*) that corresponds to the specified direction of movement blinks, and in the third mode, only one of the forward indicator (134*a*) and the reverse indicator (134*c*) that corresponds to the specified direction of movement is steadily on without blinking.

A seventh aspect of the disclosure is directed to an outboard motor (100) mountable to a watercraft (200). The outboard motor (100) includes: a thruster (105); a prime mover (104) that rotates the thruster (105); a direction-of-movement specifier (123, 124) that specifies a direction in which the watercraft (200) is to move as a specified direction of movement; a controller (110) that controls a rotation direction of the thruster based on the specified direction of movement; a direction-of-movement detector (300) that detects a direction in which the watercraft (200) actually moves as an actual direction of movement; an actual speed detector (300) that detects a speed at which the watercraft (200) actually moves as an actual speed; and a direction-of-movement indicator (133, 134) that shows an indication related to a direction of movement of the watercraft (200). The direction-of-movement indicator (133, 134) shows the indication in a first mode and a second mode, the first mode being a display mode displaying that there is a disagreement between the specified direction of movement and the actual direction of movement, the second mode being a display mode displaying that the specified direction of movement and the actual direction of movement are in agreement.

The present disclosure provides a display device and an outboard motor, with which it is possible to indicate whether a direction of movement according to operation by the pilot and the actual direction of movement of the watercraft are in agreement.

DETAILED DESCRIPTION OF THE INVENTION

First Embodiment

Figure 1:
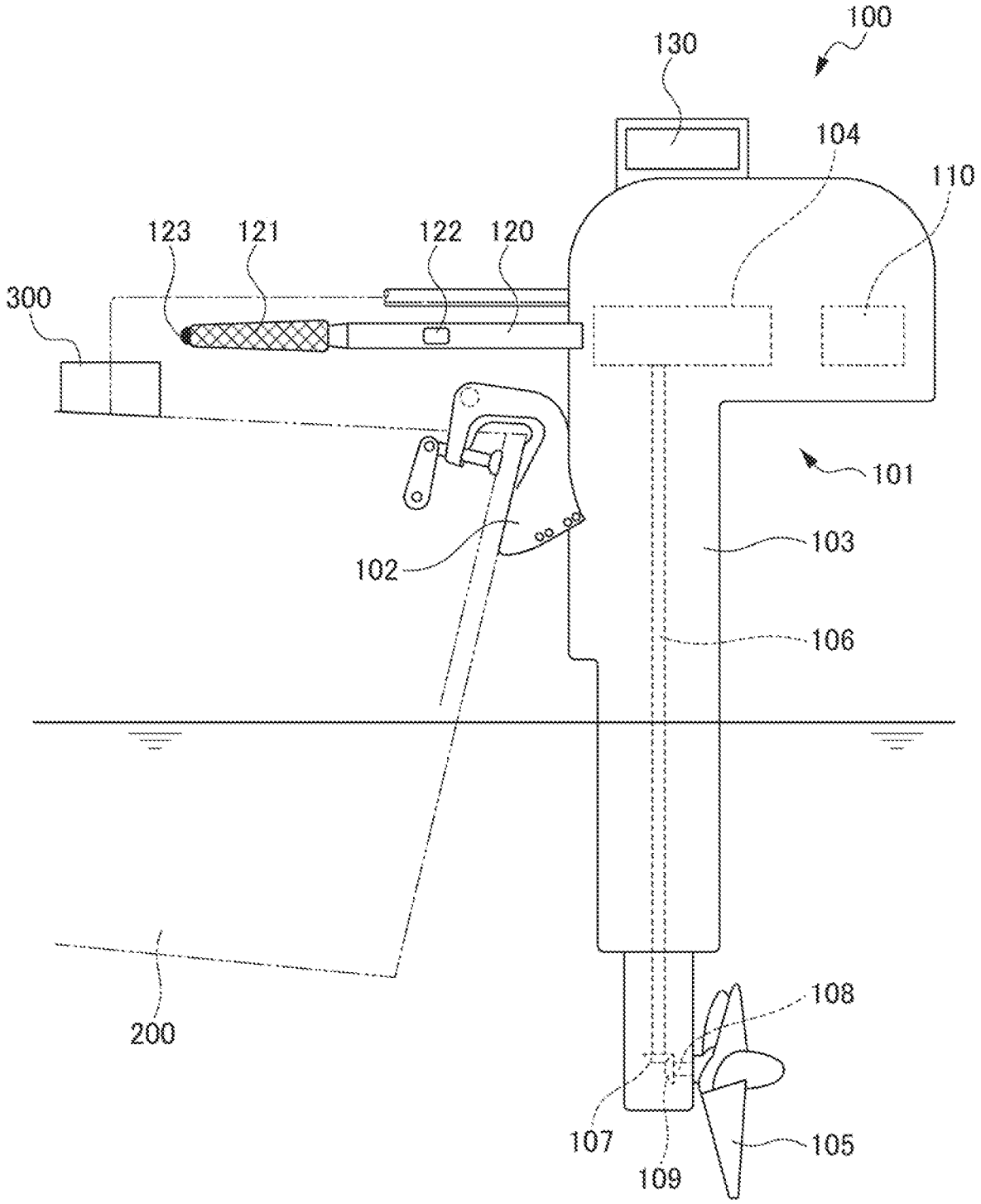
FIG. 1 is a diagram illustrating a first embodiment of an outboard motor 100 provided with a display device according to the present disclosure.

Hereinafter, embodiments for carrying out the present disclosure will be described with reference to the drawings. FIG. 1 is a diagram illustrating a first embodiment of an outboard motor 100 provided with a display device according to the present disclosure. Note that the drawings indicated hereinafter, including FIG. 1, are schematic illustrations in which each part is illustrated with the size and shape exaggerated or abbreviated, as appropriate, to facilitate understanding.

Furthermore, the following description indicates specific numerical values, shapes, materials, and the like, but these can be changed as appropriate. In the following description, directional terms such as fore, aft, up, and down are used in reference to a usage scenario in which the outboard motor 100 is mounted onto a hull 200. Note that "fore" denotes the direction in which the vessel moves forward, while "aft" denotes the direction opposite to the "fore". Also, in the following description of the embodiments, a mode in which the outboard motor 100 is mounted onto the hull 200 is given as an example, but the display device of the present disclosure is not limited to the case of using an outboard motor and is also usable in watercrafts employing a sterndrive, an inboard motor, a pod drive, or the like.

The outboard motor 100 is used by being mounted onto a hull 200. The outboard motor 100 is provided with an outboard motor body 101 and a mounting device 102 for mounting the outboard motor body 101 onto the hull 200. The outboard motor body 101 includes a body case 103, a prime mover 104, a screw propeller 105, and a controller 110. Note that although the present embodiment illustrates a mode in which the screw propeller 105 is used to obtain thrust, an outboard motor that uses a water jet to obtain thrust, for example, is also possible. Furthermore, the outboard motor body 101 includes a drive shaft 106, a propeller shaft 108, a tiller handle 120, and a display 130.

The body case 103 is formed from a metallic or plastic material and covers the internal structure of the outboard motor body 101. The upper portion of the body case 103 accommodates the prime mover 104 and the controller 110. The lower portion of the body case 103 accommodates the drive shaft 106, the propeller shaft 108, and the like.

For the prime mover 104, an electric motor, engine (internal combustion engine (ICE)), or the like for rotating the screw propeller 105 can be used. In the case of using an electric motor as the prime mover 104, a power source including a secondary battery or the like is additionally provided. The prime mover 104 is disposed in the upper portion of the body case 103 such that an output shaft thereof extends vertically downward. Note that in the case in which the prime mover 104 is an ICE, a driving direction switching mechanism is provided to switch the rotation direction of the rotary driving force to be transmitted to the drive shaft 106 between forward rotation and reverse rotation.

The drive shaft 106 extends in the vertical direction below the prime mover 104. The upper end of the drive shaft 106 is connected to the output shaft of the prime mover 104. A drive gear 107 configured as a bevel gear is united with the lower end of the drive shaft 106. The drive shaft 106 is rotatably supported by the body case 103.

The propeller shaft 108 extends in the fore-aft direction (substantially the horizontal direction) below the drive shaft 106. The propeller shaft 108 is rotatably supported by the body case 103. A driven gear 109 configured as a bevel gear to engage the drive gear 107 is united with the fore end of the propeller shaft 108. The propeller shaft 108 extends rearward from the body case 103 through a support hole (not illustrated) in the body case 103, and is exposed on the outside of the body case 103. The rotation of the drive shaft 106 is transmitted to the propeller shaft 108 through the drive gear 107 and the driven gear 109.

The screw propeller 105 is a thruster which is driven by the prime mover 104 to generate thrust. The screw propeller 105 is mounted on the rear portion of the propeller shaft 108 so as to be united with the propeller shaft 108, and can rotate with the propeller shaft 108. The screw propeller 105 is located farther rearward than the rear end of the body case 103, and is exposed on the outside of the body case 103. Multiple fins project out on the circumference of the screw propeller 105.

The tiller handle 120 extends forward (toward the hull 200) from the outboard motor body 101, and can turn with the outboard motor body 101 relative to the hull 200. The tiller handle 120 is moved left and right by the pilot to steer, which causes the outboard motor body 101 to turn left or right relative to the hull 200. The tiller handle 120 includes an accelerator grip 121 rotatably provided on the fore end of the tiller handle 120, an accelerator position sensor 122 that detects the amount of rotation inputted to the accelerator grip 121 (that is, the accelerator position), and a shift switch 123. The shift switch 123 is provided on the tip (fore end) of the tiller handle 120. The shift switch 123 may also be provided on the side of the tiller handle 120 near the tip. The position of the accelerator position sensor 122 may be near the base of the tiller handle 120 and the body case 103.

The accelerator grip 121 is normally urged by an urging member to be positioned at an initial position. The accelerator grip 121 accepts an operation of rotating to one side from the initial position and back to the other side toward the initial position as a change operation for changing the output of the prime mover 104. The accelerator position sensor 122 detects the accelerator position of the accelerator grip 121 and outputs a detection signal.

The shift switch 123 is a direction-of-movement specifier that accepts a switching operation for switching the rotation direction of the drive shaft 106 driven by the prime mover 104, and specifies the direction of movement of the watercraft as a specified direction of movement. The shift switch 123 is configured to be selectively switchable between a forward specification that causes the drive shaft 106 to rotate in a direction causing the hull 200 to move forward and a reverse specification that causes the drive shaft 106 to rotate in a direction causing the hull 200 to move in reverse. In the case in which the prime mover 104 is an electric motor, the forward specification and the reverse specification switch the rotation direction of the prime mover 104. On the other hand, in the case in which the prime mover 104 is an ICE, the rotation direction of the rotary driving force to be transmitted to the drive shaft 106 is switched between forward rotation and reverse rotation by a drive direction switching mechanism, without changing the rotation direction of the prime mover 104. In the present embodiment, a momentary switch is used for the shift switch 123. With this arrangement, the forward specification is given while the shift switch 123 is not being pressed and the reverse specification is given while the shift switch 123 is being pressed. Note that an alternate switch may also be used for the shift switch 123.

Figure 2:
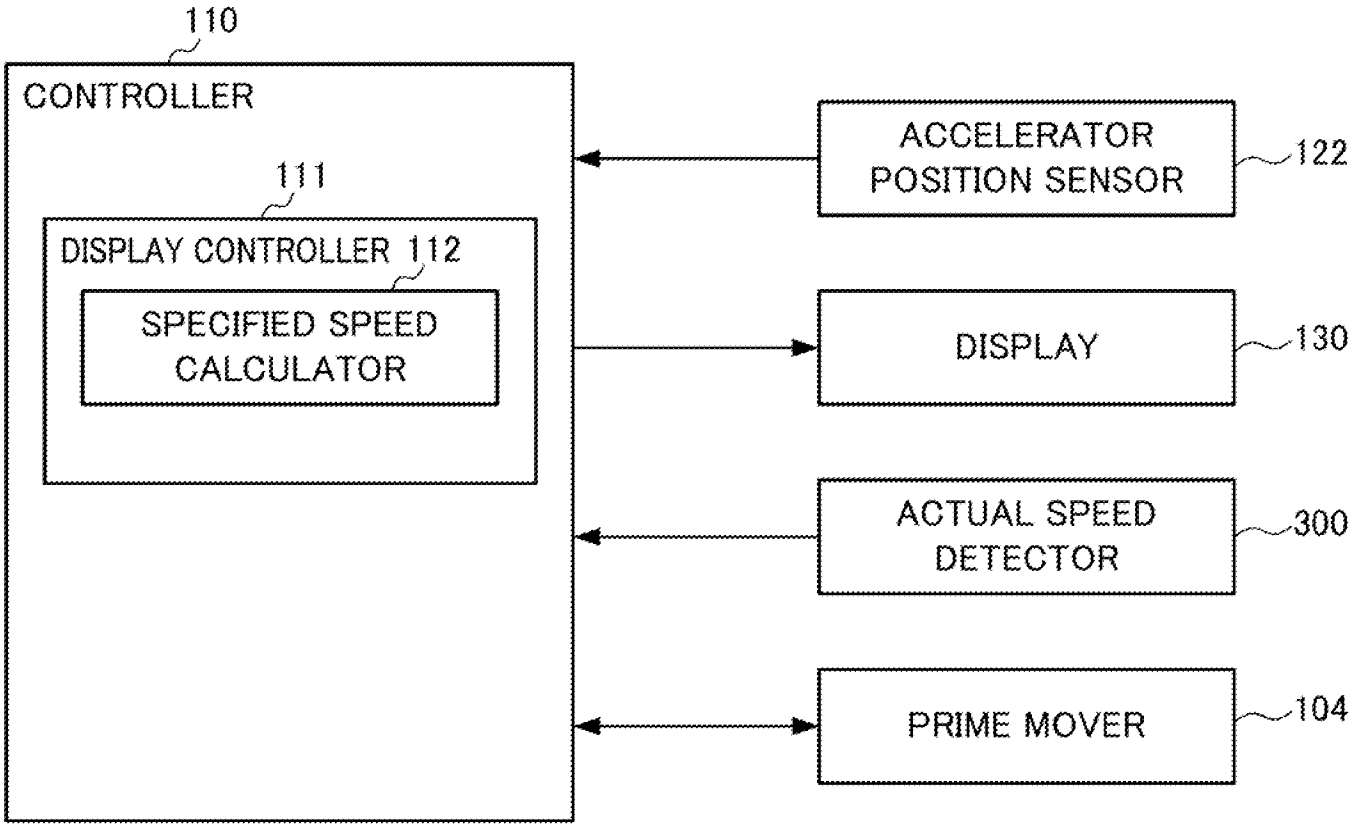
FIG. 2 is a block diagram for explaining a configuration of the display device of the outboard motor in the first embodiment.

FIG. 2 is a block diagram for explaining a configuration of the display device of the outboard motor in the first embodiment. The controller 110 includes a CPU, ROM, and RAM, for example. The controller 110 enacts various controls by loading a program stored in a storage medium such as the ROM into the RAM and executing the loaded program on the CPU.

The controller 110 acquires the amount of rotation inputted to the accelerator grip 121 (that is, the accelerator position) from the accelerator position sensor 122 and controls the rotation speed of the prime mover 104 in accordance with the amount of rotation input. The controller 110 also acquires, from the prime mover 104, the actual rotation speed of the prime mover 104 through a tachometer not illustrated. An actual speed detector 300 functions as an actual speed detector and a direction-of-movement detector that reads location information from a Global Positioning System (GPS) unit to detect the actual speed and actual direction of movement, that is, the speed and direction in which the hull 200 is actually moving. The actual speed detector 300 conveys the detected actual speed and actual direction of movement to the controller 110. Note that the actual speed detector 300 may use, not limited to GPS, but also another satellite positioning system. The actual speed detector 300 may be provided to the outboard motor 100, but the actual speed detector 300 may also be provided to the hull 200 as illustrated in FIG. 1, and multiple GPS antennas may be spaced apart from each other at multiple positions on the hull 200 to increase the positioning accuracy.

The controller 110 is provided with a display controller 111. The display controller 111 controls what is displayed on the display 130. The display controller 111 and the display 130 form the display device of the outboard motor according to the present disclosure. Note that although the present embodiment illustrates an example in which the display controller 111 is configured as part of the controller 110, the display controller 111 may also be provided as a separate configuration from the controller 110. The display controller 111 acquires the specified direction of movement, the actual direction of movement, and the actual speed, and controls the display 130, including a direction-of-movement indicator 133. The display controller 111 is provided with a specified speed calculator 112. The specified speed calculator 112 calculates a specified speed on the basis of the accelerator position (amount of input) of the accelerator grip 121 obtained from the accelerator position sensor 122. The specified speed refers to the vessel speed calculated from the accelerator position of the accelerator grip 121 rather than the speed at which the hull 200 is actually moving, and is the speed that may be reached once the speed has risen sufficiently rather than the speed while the vessel is accelerating or decelerating. Therefore, the specified speed is the vessel speed thought to be desired by the pilot according to the operation of rotating the accelerator grip 121. Note that, although not illustrated in the diagrams, information for specifying the direction of movement is also inputted into the controller 110 from the shift switch 123.

The relationship between the rotation speed of the prime mover 104 and the vessel speed is generally proportional, for example, and can be expressed as a function of the rotation speed of the prime mover 104 and the vessel speed. Note that although the rotation speed of the prime mover 104 is used in this case, the same applies to the case of using the rotation speed of the drive shaft 106 or the propeller shaft 108. The specified speed calculator 112 stores a function expressing the relationship between the rotation speed of the prime mover 104 and the vessel speed, for example, and calculates a specified speed based on the accelerator position (amount of input) of the accelerator grip 121. Note that although the function expressing the relationship between the rotation speed of the prime mover 104 and the vessel speed is assumed to be stored in advance, for example, the specified speed calculator 112 may also be configured to accumulate movement data and execute machine learning to update the relationship between the rotation speed of the prime mover 104 and the vessel speed. Additionally, the specified speed calculator 112 may also accept the input of data pertaining to a hull model (the length and size of the hull) and load capacity depending on the cargo, number of occupants, and the like, and calculate a specified speed that takes this data into account.

The display controller 111 displays information on the display 130 on the basis of the specified direction of movement specified by the operation of the shift switch 123, the actual speed and actual direction of movement detected by the actual speed detector 300, and the specified speed based on an operation by the user and calculated by the specified speed calculator 112 described above. More specifically, the display controller 111 switches the display mode to be shown on the display 130 among three display modes, namely a first mode, a second mode, and a third mode. The first mode indicates that there is a disagreement between the specified direction of movement and the actual direction of movement. The second mode indicates that the specified direction of movement and the actual direction of movement are in agreement. The third mode indicates that the specified speed and the actual speed are in agreement.

Figure 3:
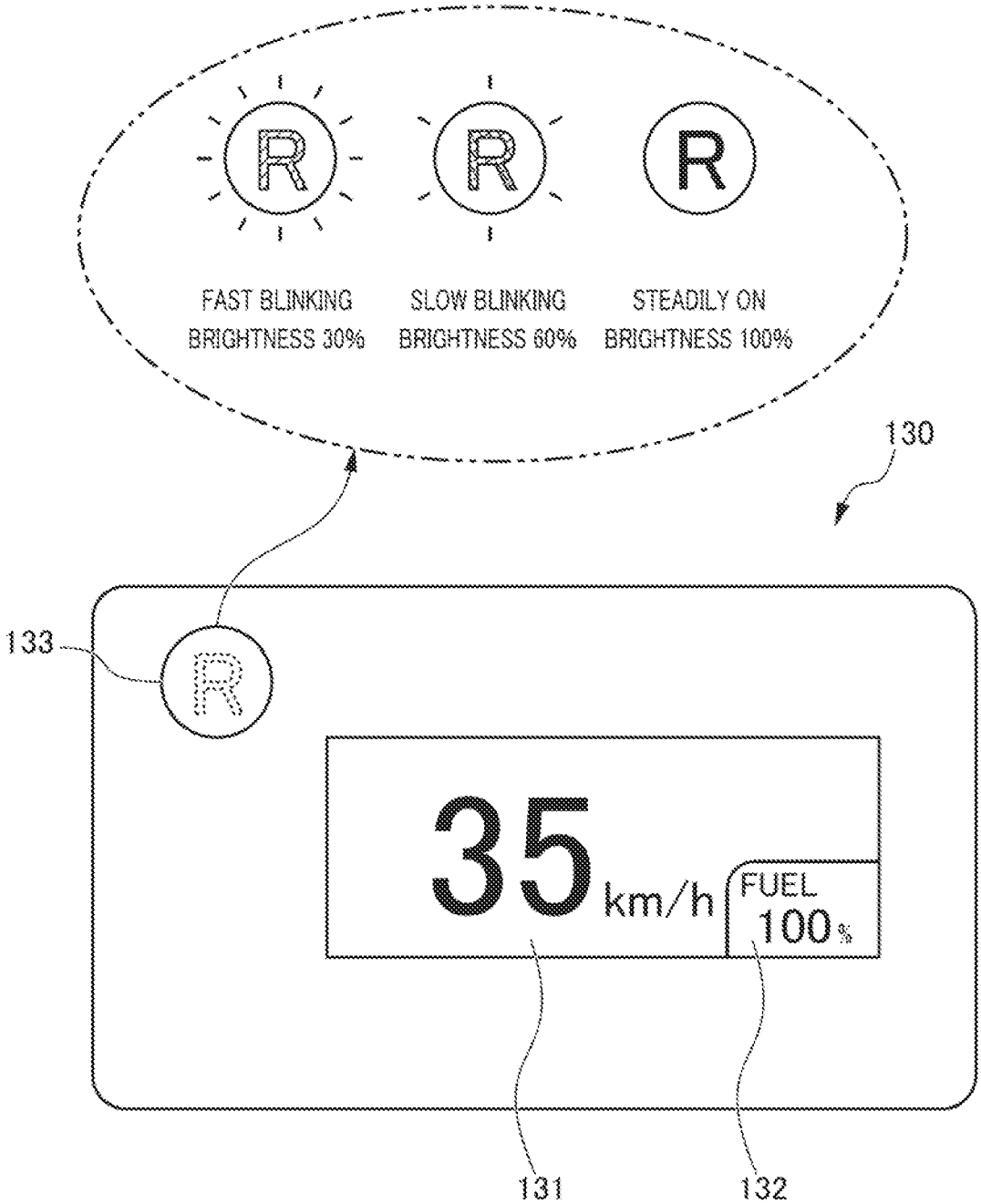
FIG. 3 is a diagram for explaining multiple display forms of a direction-of-movement indicator 133 in the first embodiment.

In the first embodiment, the three display modes of the first mode, the second mode, and the third mode are achieved by altering the display mode of the direction-of-movement indicator 133. Accordingly, first, changes to the display mode of the direction-of-movement indicator 133 will be described. FIG. 3 is a diagram for explaining multiple display forms of the direction-of-movement indicator 133 in the first embodiment. In FIG. 3, the display modes of the direction-of-movement indicator 133 are illustrated in the upper part of FIG. 3. As illustrated in FIG. 3, the display 130 is provided with an actual speed indicator 131, a fuel indicator 132, and the direction-of-movement indicator 133, for example. Note that only the actual speed indicator 131, the fuel indicator 132, and the direction-of-movement indicator 133 are illustrated in FIG. 3, but other information may also be displayed nearby.

The actual speed indicator 131 shows the actual speed detected by the actual speed detector 300. In the actual speed detector 300, the speed is denoted by a positive numerical value when moving forward and a negative numerical value when moving in reverse. The fuel indicator 132 show the amount of fuel remaining as a percentage.

Note that in FIG. 3, "FUEL" is displayed to correspond to the case in which the prime mover 104 is an engine, but in the case in which the prime mover 104 is an electric motor, "BATTERY" is displayed instead. The actual speed indicator 131 and the fuel indicator 132 can be configured as a display panel, such as a liquid crystal display (LCD) panel or an organic light-emitting diode (OLED) panel, for example.

The direction-of-movement indicator 133 shows information related to the direction of movement of the watercraft. In the first embodiment, the direction-of-movement indicator 133 is a light-emitting display in which the letter "R" is switched between being turned on, blinking, and being turned off when the specified direction of movement is reverse. For example, the direction-of-movement indicator 133 can be configured as a back-illuminated display device using a light-emitting diode (LED) as a light source. Note that an OLED panel may also be used to configure the direction-of-movement indicator 133 as a single display panel that also includes the actual speed indicator 131 and the fuel indicator 132.

In the direction-of-movement indicator 133, the three display modes of the first mode, the second mode, and the third mode are displayed as the three display modes illustrated in the upper part of FIG. 3. In FIG. 3 and the drawings to be described later, the three display modes of the direction-of-movement indicator 133 are represented by the shading of the display characters and the radial lines provided around the display characters. A first display form (corresponding to the first mode) of the direction-of-movement indicator 133 is the display state illustrated on the left side of the upper part of FIG. 3, in which blinking occurs in a short blinking cycle (fast blinking) and the brightness is lower than a second display mode to be described later, such as a blinking cycle of 0.5 seconds at 30% brightness, for example. Note that 30% brightness means the brightness for the case in which the maximum brightness is defined as 100% brightness; the same applies in the description hereinafter.

A second display form (corresponding to the second mode) of the direction-of-movement indicator 133 is the display state illustrated in the middle of the upper part of FIG. 3, in which blinking occurs in a longer blinking cycle (slow blinking) than the first display form and the brightness is higher than the first display form, such as a blinking cycle of 1 second at 60% brightness, for example. Note that the blinking cycle and brightness of the direction-of-movement indicator 133 may be modified as appropriate.

A third display form (corresponding to the third mode) of the direction-of-movement indicator 133 is the display state illustrated on the right side of the upper part of FIG. 3, in which the display is steadily on in a sustained way without blinking and the brightness is higher than the second display form, such as 100% brightness, for example. Note that on the display 130 illustrated in FIG. 3, the direction-of-movement indicator 133 is turned off, which is a display mode displaying that the vessel is moving forward normally and the specified direction of movement and the actual direction of movement are in agreement.

In the present disclosure, "steadily on" refers to a lighted state in which the display is not observed to be blinking when observed by the human eye, but rather is observed as being turned on in a sustained way. Consequently, in the case of using an LED as the light source of the direction-of-movement indicator 133, the state of being turned on is, in actuality, a state of blinking at a high frequency, but this state of blinking at a high frequency that is substantially observed as being steadily on is treated as a steadily-on state in the present disclosure. Similarly, "blinking" in the present disclosure refers to a state in which the display is not observed to be turned on in a sustained way when observed by the human eye, but rather is observed as blinking in which the display is turned on and off repeatedly.

Figure 4:
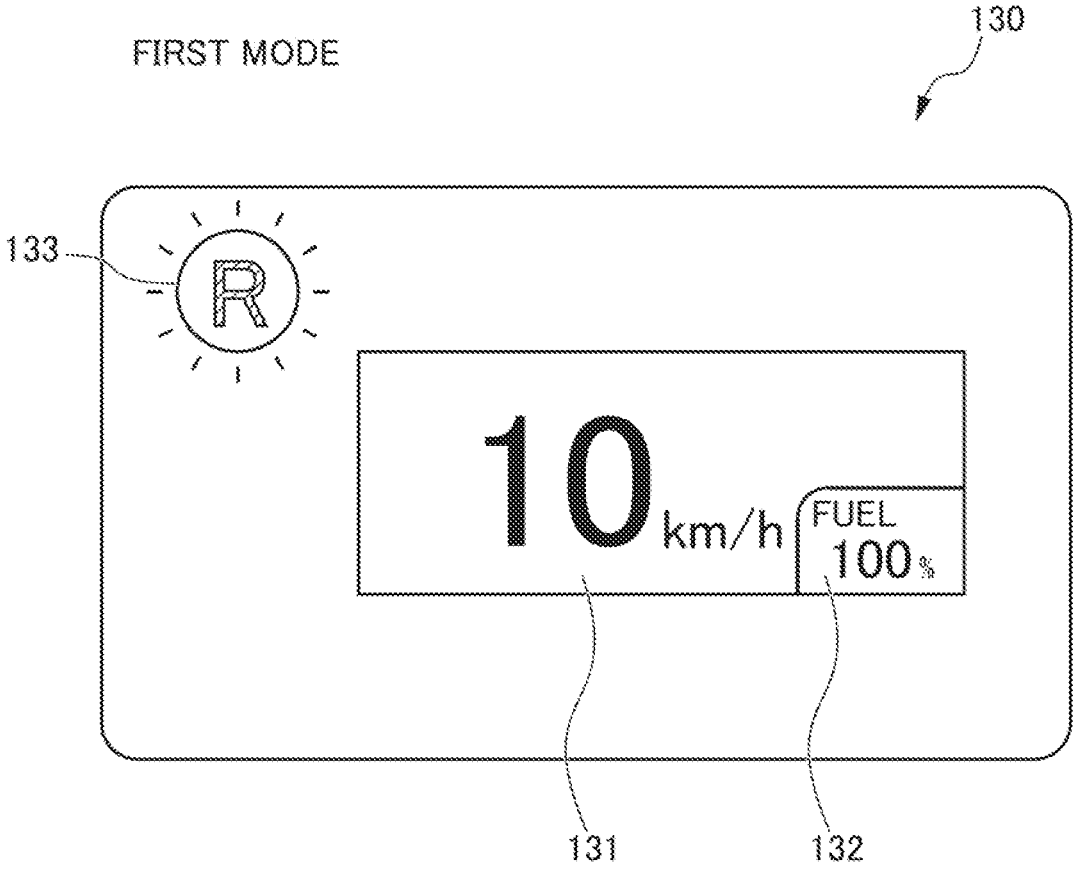
FIG. 4 is a diagram illustrating a display 130 showing a first mode in the first embodiment.

Next, the switching among the three display modes of the first mode, the second mode, and the third mode by the display controller 111 in the first embodiment will be described. The following mainly describes changes to what is displayed on the display 130 when the shift switch 123 is operated to give the reverse specification while the vessel is moving forward. When the vessel is moving forward normally and the specified direction of movement and the actual direction of movement are in agreement, the direction-of-movement indicator 133 is turned off and the actual speed indicator 131 indicates the actual speed at the time with a positive numerical value (the display mode in FIG. 3). In this state, if the reverse specification is given by the shift switch 123, the rotation direction of the drive shaft 106 switches to the direction causing the hull 200 to move in reverse. However, the direction of movement of the hull 200 does not reverse immediately and continues to be forward for some time. In this case, there is a disagreement between the specified direction of movement and the actual direction of movement, and therefore the display controller 111 causes the display 130 to show the first mode. FIG. 4 is a diagram illustrating the display 130 showing the first mode in the first embodiment. The direction-of-movement indicator 133 in the first mode shows the first display form described above. That is, the direction-of-movement indicator 133 in the first mode shows a display in which blinking occurs in a short blinking cycle (fast blinking) and the brightness is lower than the second display mode described later, such as 30% brightness, for example. With the first mode, the pilot easily becomes aware of the disagreement between the specified direction of movement and the actual direction of movement, thereby enabling prevention of confusion.

Figure 5:
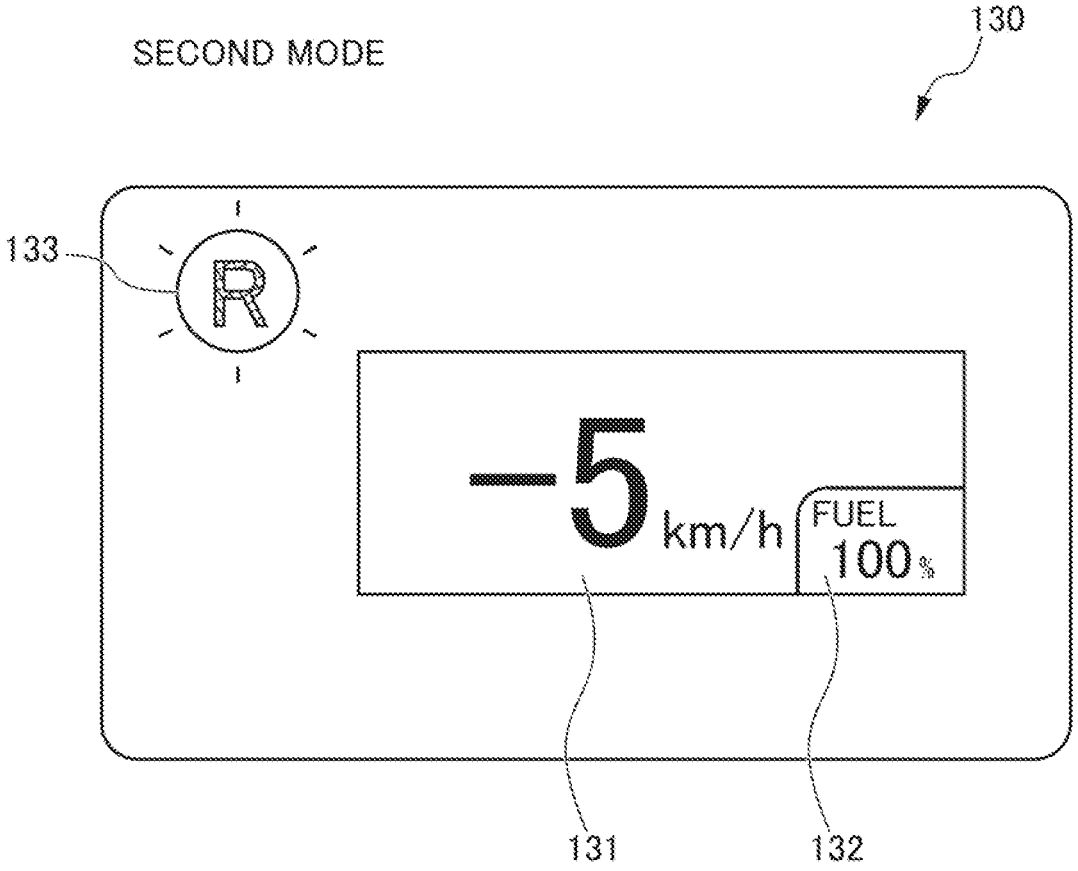
FIG. 5 is a diagram illustrating the display 130 showing a second mode in the first embodiment.

If the reverse specification continues while there is the disagreement between the specified direction of movement and the actual direction of movement, the forward speed of the hull 200 will drop further, and the direction of movement will switch to reverse. When this state is reached, the specified direction of movement and the actual direction of movement are in agreement, and therefore the display controller 111 causes the display 130 to show the second mode. FIG. 5 is a diagram illustrating the display 130 showing the second mode in the first embodiment. The direction-of-movement indicator 133 in the second mode shows the second display form described above. That is, the direction-of-movement indicator 133 in the second mode shows a display in which blinking occurs in a longer blinking cycle (slow blinking) than the first mode and the brightness is higher than the first mode, such as 60% brightness, for example. In the second mode, the blinking cycle is longer and the brightness is higher than in the first mode, and therefore the pilot can easily grasp that the specified direction of movement and the actual direction of movement are in agreement.

Figure 6:
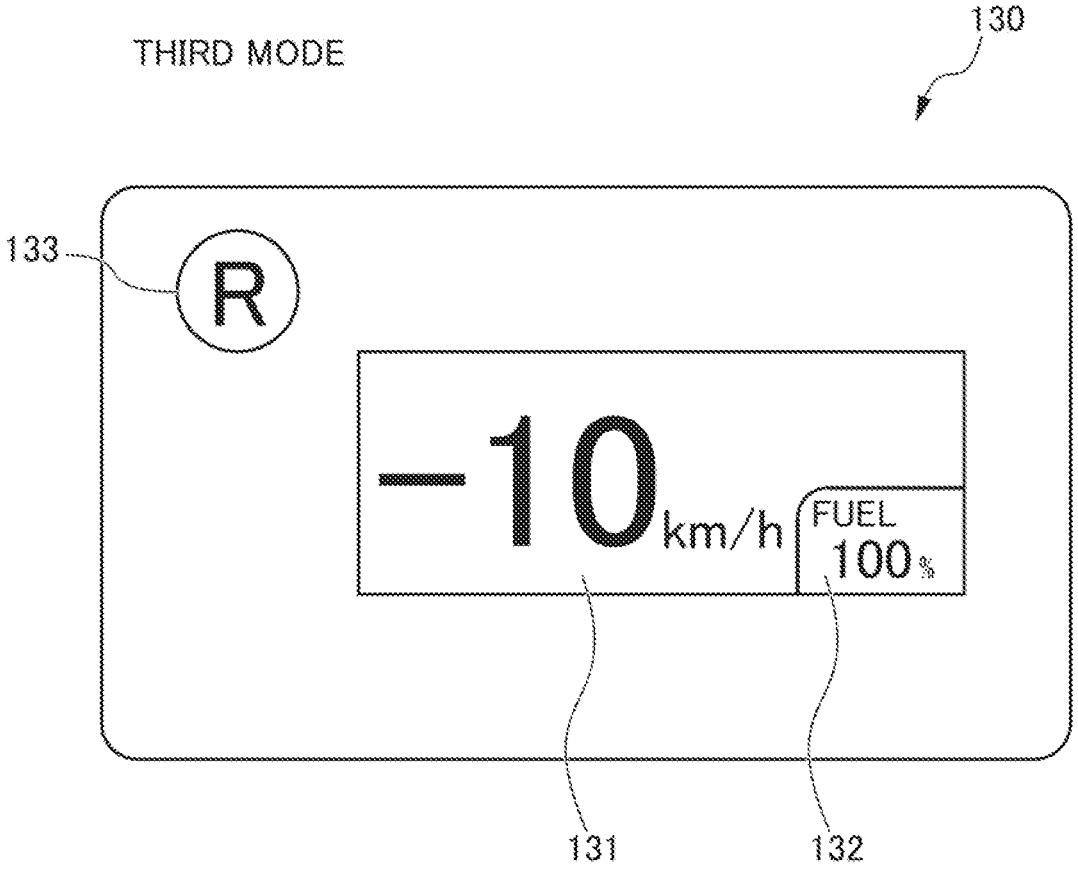
FIG. 6 is a diagram illustrating the display 130 showing a third mode in the first embodiment.

If the reverse specification continues further while the display 130 is showing the second mode, that is, while the specified direction of movement and the actual direction of movement are in agreement, the reverse speed will gradually increase, the actual speed will reach the specified speed, and the specified speed and the actual speed will be in agreement. When the specified speed and the actual speed are in agreement, the display controller 111 causes the display 130 to show the third mode. FIG. 6 is a diagram illustrating the display 130 showing the third mode in the first embodiment. The example in FIG. 6 illustrates a case in which the specified speed of moving in reverse is 10 km, the actual speed displayed by the actual speed indicator 131 is −10 km, the specified speed and the actual speed are in agreement, and the third mode is shown. The direction-of-movement indicator 133 in the third mode shows the third display form described above. That is, the direction-of-movement indicator 133 in the third mode shows a display that is steadily on in a sustained way without blinking at a brightness higher than the second mode, such as 100% brightness, for example. In the third mode, the direction-of-movement indicator 133 is turned on brightly without blinking, and therefore the pilot can easily confirm that the vessel is being maneuvered appropriately, allowing the pilot to maneuver the vessel with assurance. Note that "the specified speed and the actual speed are in agreement" allows for some marginal difference between the speeds, and does not mean that the speeds are exactly the same in a strict sense. For example, the specified speed and the actual speed may be considered to be "in agreement" if the speed difference is within ±5 km, but the speed difference set as the allowable margin is also modifiable as appropriate.

Second Embodiment

Figure 7:
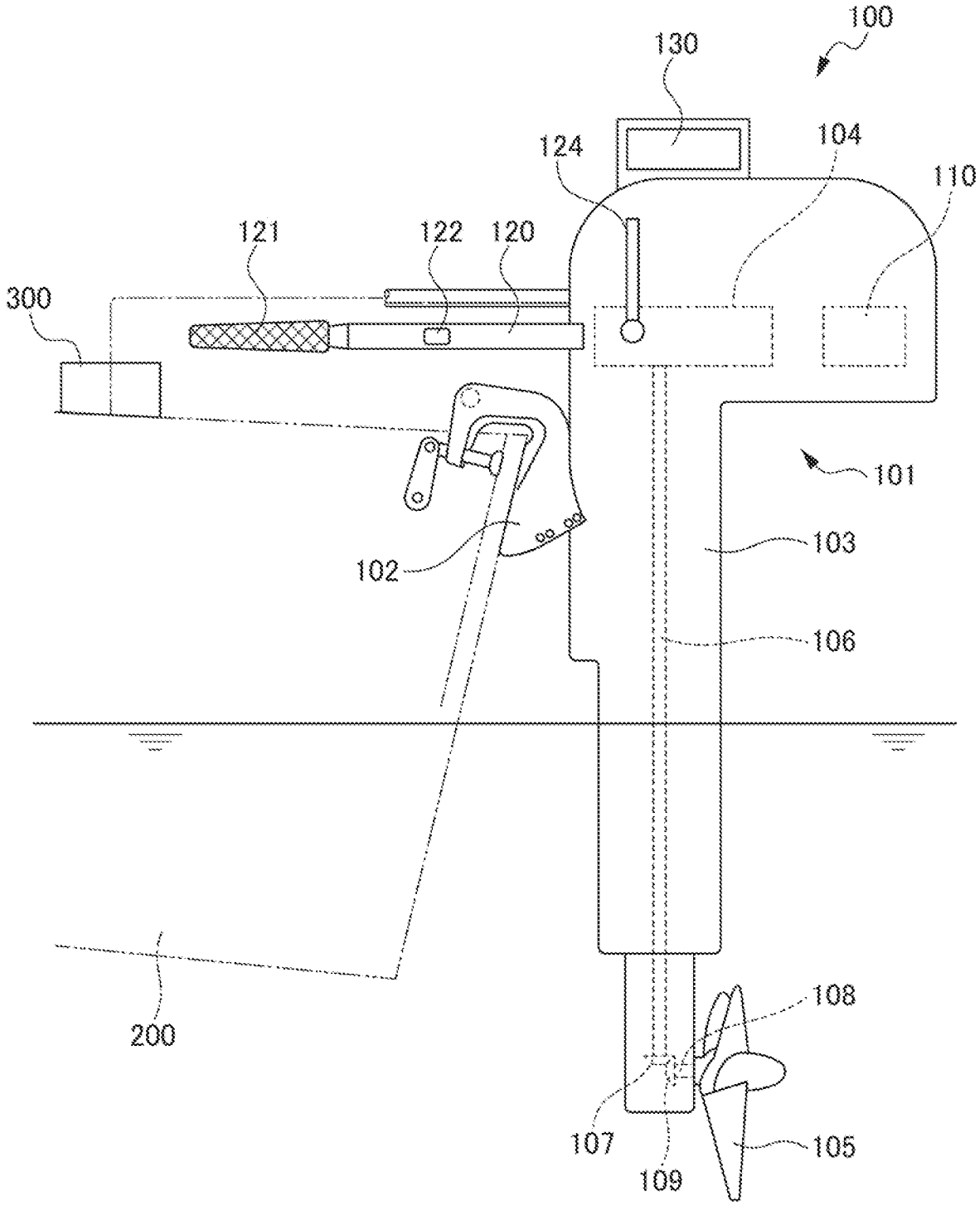
FIG. 7 is a diagram illustrating a second embodiment of an outboard motor 100 provided with a display device according to the present disclosure.

FIG. 7 is a diagram illustrating a second embodiment of an outboard motor 100 provided with a display device according to the present disclosure. In the display device according to the second embodiment, a shift lever 124 is provided instead of the shift switch 123 in the first embodiment, and accordingly, the forms and display operations of a direction-of-movement indicator 134 are different, but otherwise the display device according to the second embodiment is similar to the display device according to the first embodiment. Therefore, parts that fulfill functions similar to the first embodiment described above are denoted with the same signs, and a duplicate description of such parts is omitted where appropriate.

As illustrated in FIG. 7, the outboard motor 100 according to the second embodiment is provided a shift lever 124 as a direction-of-movement specifier instead of the shift switch 123 in the first embodiment. The pilot operates the shift lever 124 in the fore-aft direction to switch among the forward specification, neutral, and reverse specification. Neutral refers to a non-engaged state (neutral state) in which a clutch, not illustrated, is released. Information for specifying the direction of movement according to the operating position of the shift lever 124 is inputted into the controller 110.

Figure 8:
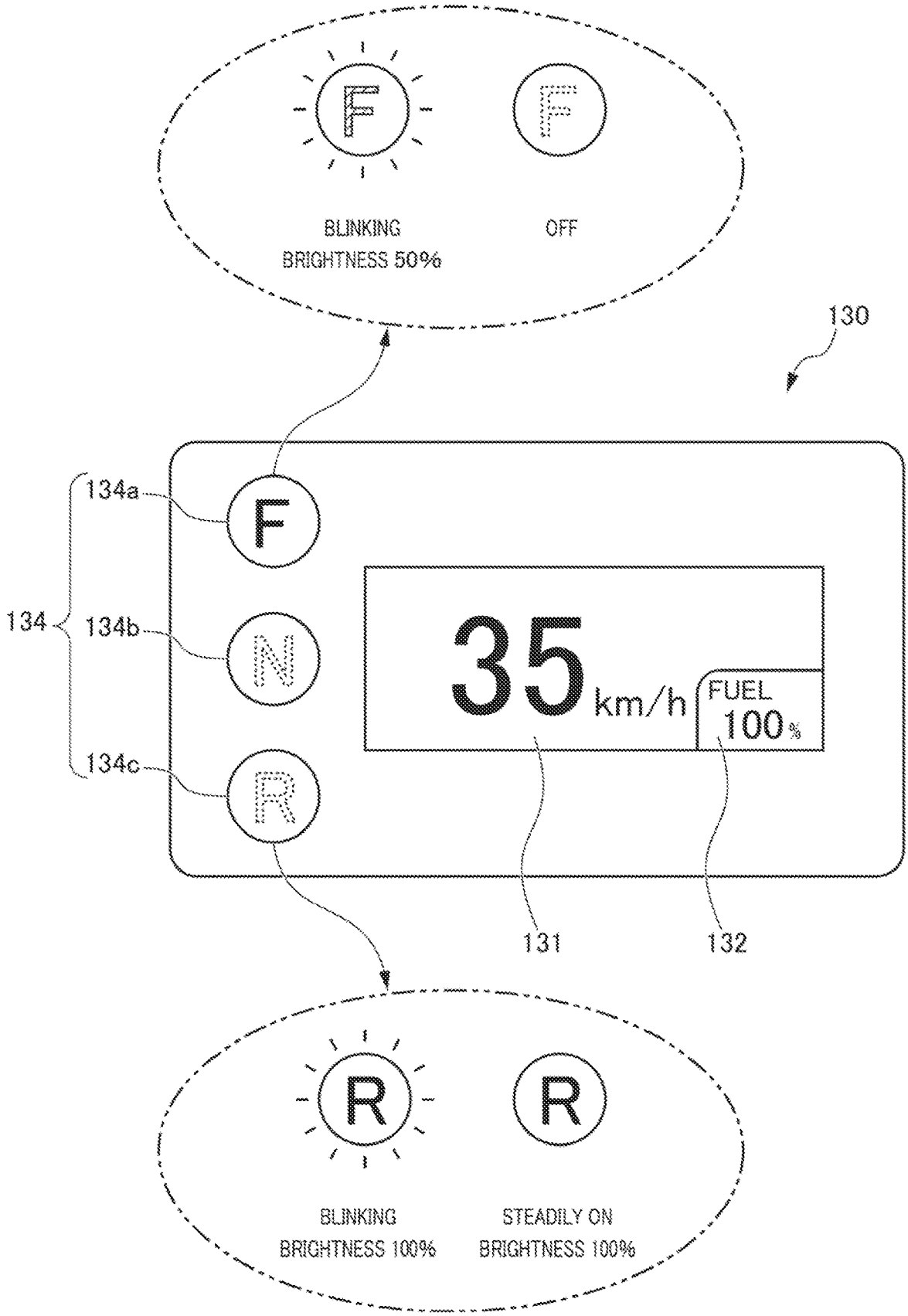
FIG. 8 is a diagram for explaining multiple display forms of a direction-of-movement indicator 134 in the second embodiment.

FIG. 8 is a diagram for explaining multiple display forms of the direction-of-movement indicator 134 in the second embodiment. The direction-of-movement indicator 134 in the second embodiment is provided with a forward indicator 134*a* to indicate moving forward, a neutral indicator 134*b* to indicate the neutral position, and a reverse indicator 134*c* to indicate moving in reverse. In the forward indicator 134*a*, the letter "F", which indicates forward, is switched between being turned on, blinking, and being turned off. In the neutral indicator 134*b*, the letter "N", which indicates neutral, is switched between being turned on and off. In the reverse indicator 134*c*, the letter "R", which indicates reverse, is switched between being turned on, blinking, and being turned off. For example, the direction-of-movement indicator 134 can be configured as a back-illuminated display device using a light-emitting diode (LED) as a light source. Note that an OLED panel may also be used to configure the direction-of-movement indicator 134 as a single display panel that also includes the actual speed indicator 131 and the fuel indicator 132.

In the second embodiment, the direction-of-movement indicator 134 likewise shows the three display modes of the first mode, the second mode, and the third mode, but the specific display forms differ from the first embodiment. In the second embodiment, the direction-of-movement indicator 134 displays the three display modes of the first mode, the second mode, and the third mode by combining two display modes for each of the forward indicator 134*a* and the reverse indicator 134*c* illustrated in the upper and lower parts of FIG. 8.

A first display form of the forward indicator 134*a* is the display state illustrated on the left side of the upper part of FIG. 8, in which blinking occurs at brightness lower than maximum brightness (100% brightness), such as 50% brightness, for example. A second display form of the forward indicator 134*a* is the turned-off state illustrated on the right side of the upper part of FIG. 8.

A first display form of the reverse indicator 134*c* is the display state illustrated on the left side of the lower part of FIG. 8, in which blinking occurs at a brightness higher than the brightness in the blinking state of the forward indicator 134*a*, such as 100% brightness, for example. A second display form of the reverse indicator 134*c* is the display state illustrated on the right side of the lower part of FIG. 8, in which the display is steadily on in a sustained way without blinking and the brightness is at 100% brightness, for example. Note that the forward indicator 134*a*, the neutral indicator 134*b*, and the reverse indicator 134*c* can all be set to a turned-off state or a steadily-on state, too.

On the display 130 illustrated in FIG. 8, the forward indicator 134*a* is in the state of being steadily on in a sustained way without blinking, while the neutral indicator 134*b* and the reverse indicator 134*c* are in the turned-off state. This display mode of the display 130 illustrated in FIG. 8 indicates that the vessel is moving forward normally and the specified direction of movement and the actual direction of movement are in agreement.

Next, the switching among the three display modes of the first mode, the second mode, and the third mode by the display controller 111 in the second embodiment will be described. The following mainly describes changes to what is displayed on the display 130 when the shift lever 124 is operated to give the reverse specification while the vessel is moving forward. When the vessel is moving forward normally and the specified direction of movement and the actual direction of movement are in agreement, the forward indicator 134*a* is turned on, the neutral indicator 134*b* and the reverse indicator 134*c* are both turned off, and the actual speed indicator 131 indicates the actual speed at the time with a positive numerical value (the display mode in FIG. 8). In this state, if the reverse specification is given by the shift lever 124, the rotation direction of the drive shaft 106 switches to the direction causing the hull 200 to move in reverse. However, the direction of movement of the hull 200 does not reverse immediately and continues to be forward for some time. In this case, there is a disagreement between the specified direction of movement and the actual direction of movement, and therefore the display controller 111 causes the display 130 to show the first mode.

Figure 9:
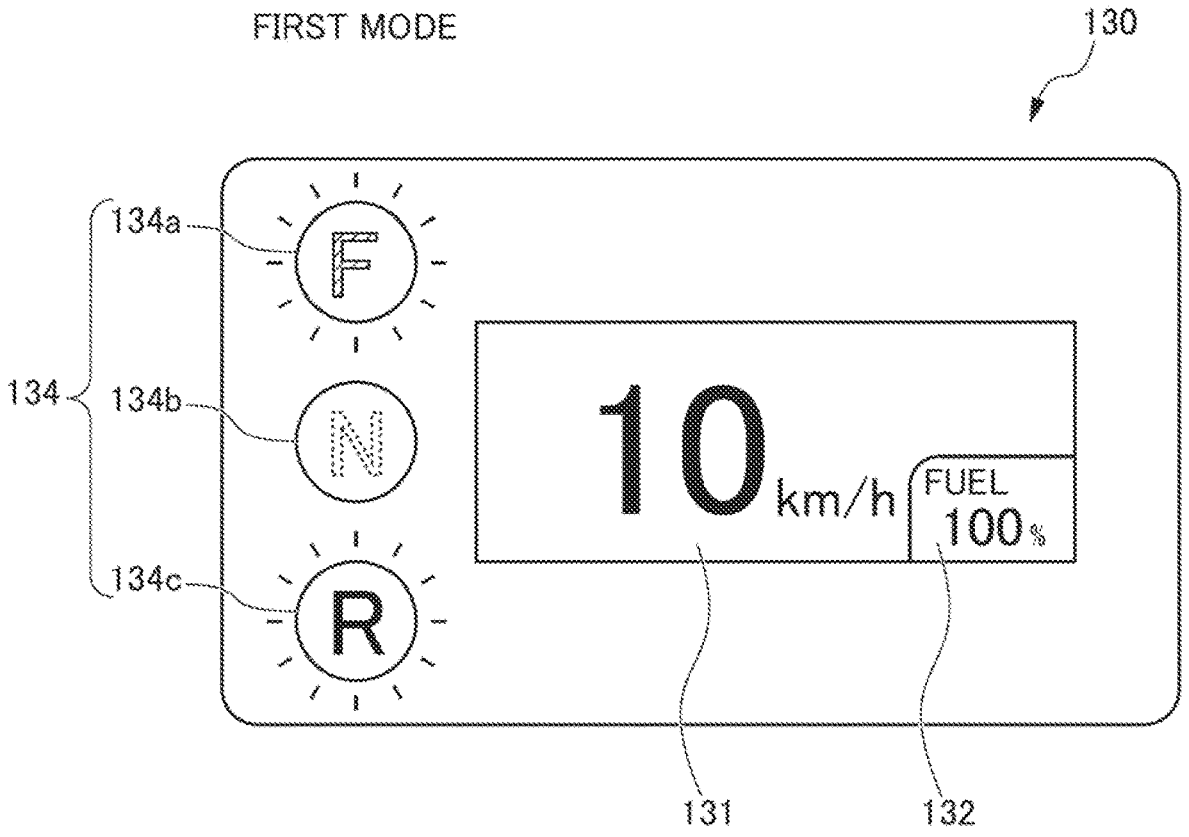
FIG. 9 is a diagram illustrating a display 130 showing a first mode in the second embodiment.

FIG. 9 is a diagram illustrating the display 130 showing the first mode in the second embodiment. In the first mode, the forward indicator 134*a* and the reverse indicator 134*c* both blink, with the brightness of the reverse indicator 134*c* at 100%, for example, and the brightness of the forward indicator 134*a* at 50%, for example. Also, the neutral indicator 134*b* is kept off. That is, the forward indicator 134*a* and the reverse indicator 134*c* both blink, and one of the forward indicator 134*a* and the reverse indicator 134*c* that corresponds to the specified direction of movement is displayed brighter than the indicator that does not correspond to the specified direction of movement. With the first mode, since the forward indicator 134*a* and the reverse indicator 134*c* both blink, the pilot easily becomes aware of the disagreement between the specified direction of movement and the actual direction of movement, thereby enabling prevention of confusion. Moreover, since the indicator corresponding to the specified direction of movement is displayed brighter than the indicator not corresponding to the specified direction of movement, the pilot can correctly recognize which direction is the specified direction of movement, as well.

Figure 10:
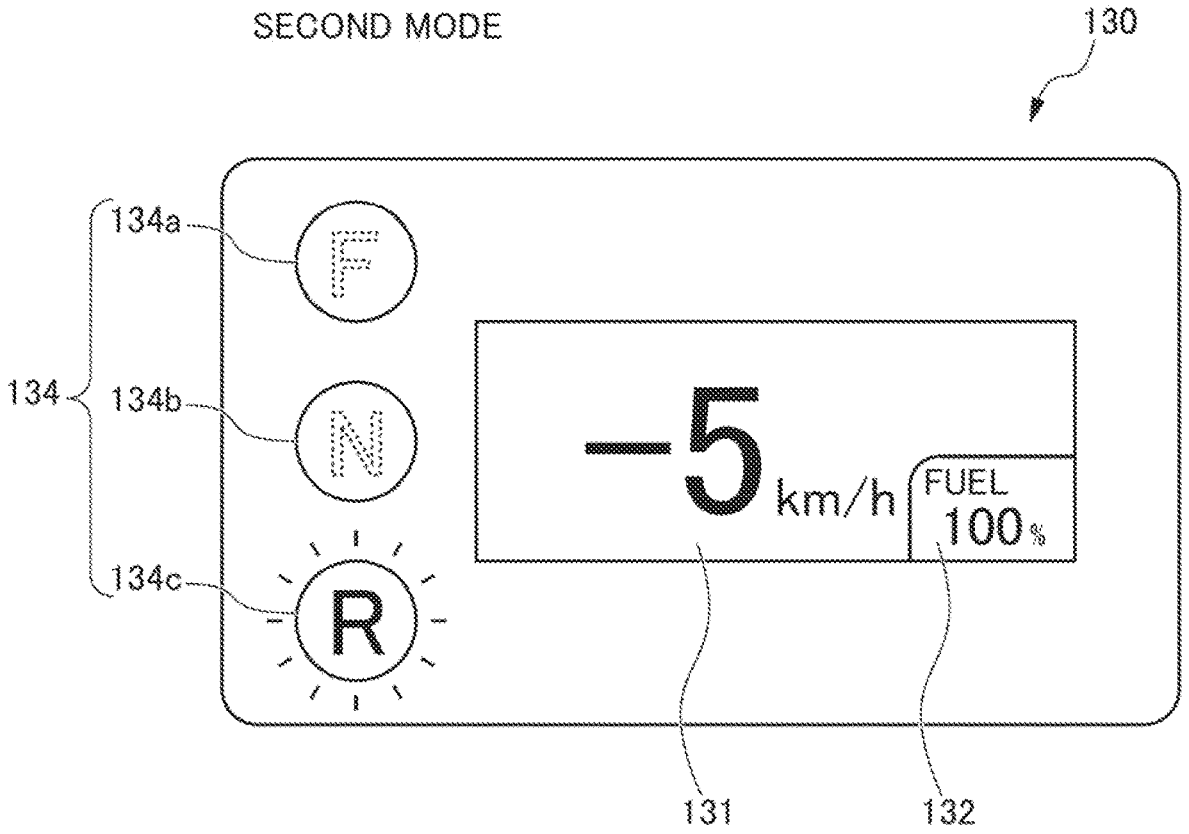
FIG. 10 is a diagram illustrating the display 130 showing a second mode in the second embodiment.

If the reverse specification continues while there is the disagreement between the specified direction of movement and the actual direction of movement, the forward speed of the hull 200 will drop further, and the direction of movement will switch to reverse. When this state is reached, the specified direction of movement and the actual direction of movement are in agreement, and therefore the display controller 111 causes the display 130 to show the second mode. FIG. 10 is a diagram illustrating the display 130 showing the second mode in the second embodiment. In the second mode, only the reverse indicator 134*c* blinks, the forward indicator 134*a* is turned off, and the neutral indicator 134*b* is kept off. That is, in the second mode, only one of the forward indicator 134*a* and the reverse indicator 134*c* that corresponds to the specified direction of movement blinks. With the second mode, since only the indicator corresponding to the specified direction of movement blinks, the pilot can easily grasp that the specified direction of movement and the actual direction of movement are in agreement, and the pilot can also correctly recognize which direction is the specified direction of movement.

Figure 11:
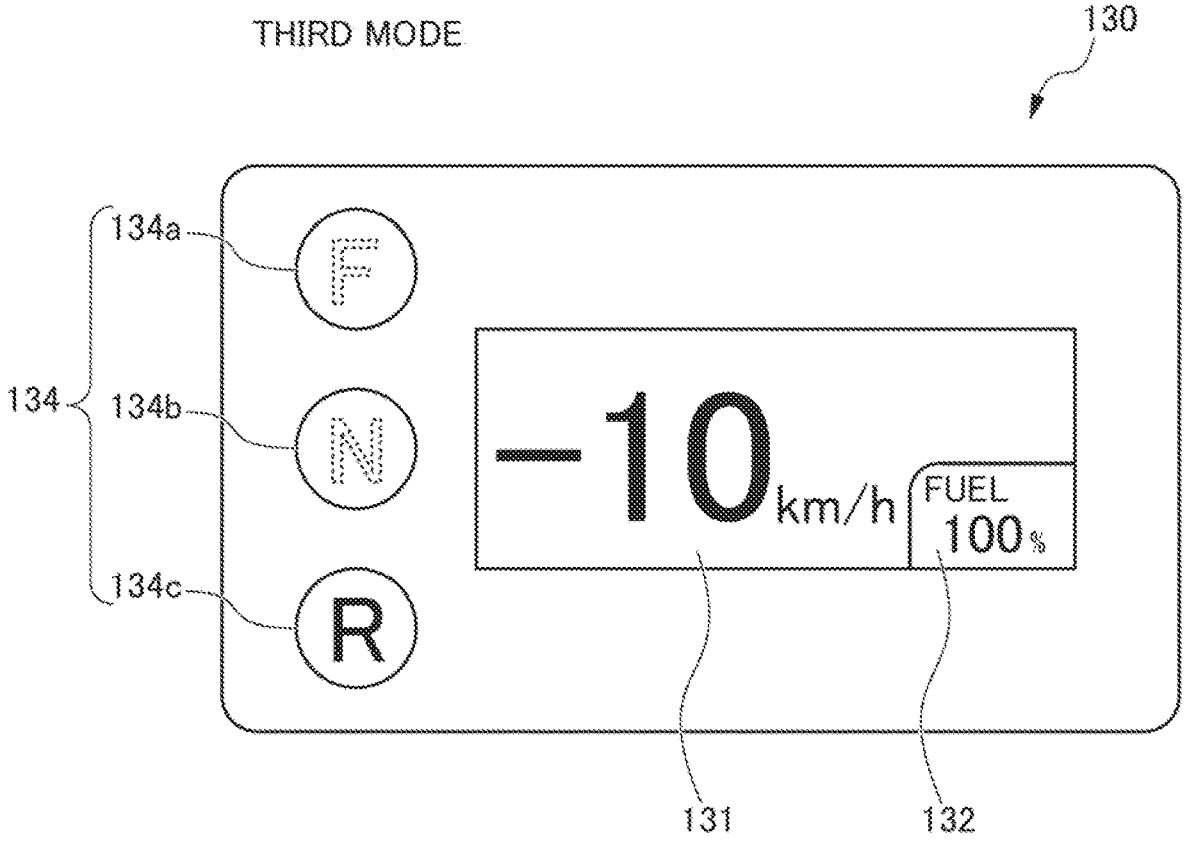
FIG. 11 is a diagram illustrating the display 130 showing a third mode in the second embodiment.

If the reverse specification continues further while the display 130 is showing the second mode, that is, while the specified direction of movement and the actual direction of movement are in agreement, the reverse speed will gradually increase, the actual speed will reach the specified speed, and the specified speed and the actual speed will be in agreement. When the specified speed and the actual speed are in agreement, the display controller 111 causes the display 130 to show the third mode. FIG. 11 is a diagram illustrating the display 130 showing the third mode in the second embodiment. The example in FIG. 11 illustrates a case in which the specified speed of moving in reverse is 10 km, the actual speed displayed by the actual speed indicator 131 is-10 km, the specified speed and the actual speed are in agreement, and the third mode is shown. The direction-of-movement indicator 134 in the third mode causes only the reverse indicator 134*c* to be steadily on in a sustained way without blinking at 100% brightness, for example, and keeps the forward indicator 134*a* and the neutral indicator 134*b* turned off. That is, in the third mode, only one of the forward indicator 134*a* and the reverse indicator 134*c* that corresponds to the specified direction of movement (in the above example, only the reverse indicator 134*c*) is steadily on without blinking. In the third mode, only the reverse indicator 134*c* is turned on brightly without blinking, and therefore the pilot can easily confirm that the vessel is being maneuvered appropriately, allowing the pilot to maneuver the vessel with assurance. Note that although the second embodiment describes operations when the reverse specification is given while the vessel is moving forward, a similar display can also be presented when the forward specification is given while the vessel is moving in reverse.

Modifications of Embodiments

The present disclosure is not limited to the embodiments described above and may be subjected to various modifications and alterations which also fall within the scope of the present disclosure.

(1) In the first embodiment, the direction-of-movement indicator 133 illustrates an example in which the direction-of-movement indicator 133 expresses three display modes by combining brightness and blinking. The configuration is not limited to the above, and three display modes may also be expressed using blinking only without changing brightness, for example.

(2) In each of the embodiments, the cycle in which the direction-of-movement indicator 133, 134 blinks may be changed gradually. For example, the cycle in which the direction-of-movement indicator blinks in the first mode may be changed according to the degree of disagreement between the specified direction of movement and the actual direction of movement. The "degree of disagreement between the specified direction of movement and the actual direction of movement" can be expressed by the absolute value of the actual speed when the specified direction of movement and the actual direction of movement are in a disagreement state. The greater the absolute value of the actual speed is in this case, the greater the degree of disagreement is. Also, in this case, as the specified direction of movement and the actual direction of movement approach agreement, the blinking cycle may approach the cycle in which the direction-of-movement indicator in the second mode blinks. Specifically, for example, when the direction-of-movement indicator in the second mode blinks in a 1-second cycle, the cycle in which the direction-of-movement indicator in the first mode blinks is varied from 0.1 seconds to 1 second. Moreover, an example of a mode can be given in which the greater the absolute value of the actual speed is, the more the blinking cycle of the direction-of-movement indicator is shortened, such that the blinking cycle is changed to approach 1 second in a continuous or stepwise manner as the absolute value of the actual speed approaches 0.

(3) Each of the embodiments gives examples of specific numerical values for the brightness of the direction-of-movement indicator 133, 134, but these brightness values may be changed as appropriate.

Note that the embodiments and modifications may also combined as appropriate and used, but a detailed description is omitted. Furthermore, the present disclosure is not limited by the embodiments described above.

EXPLANATION OF REFERENCE NUMERALS

100: outboard motor
101: outboard motor body
102: mounting device
103: body case
104: prime mover
105: screw propeller
106: drive shaft
107: drive gear
108: propeller shaft
109: driven gear
110: controller
111: display controller
112: specified speed calculator
120: tiller handle
121: accelerator grip
122: accelerator position sensor
123: shift switch
124: shift lever
130: display
131: actual speed indicator
132: fuel indicator
133: direction-of-movement indicator
134: direction-of-movement indicator
134*a*: forward indicator
134*b*: neutral indicator
134*c*: reverse indicator
200: hull
300: actual speed detector

What is claimed is:

1. A display device for use on a watercraft to display a state of movement of the watercraft on a display, wherein the display device is mounted on an outboard motor of the watercraft, the display device comprising:

a display controller that controls indication on the display, wherein the display controller acquires a specified direction of movement, an actual direction of movement, and an actual speed, the specified direction of movement being a specified direction in which the watercraft is to move in accordance with an instruction based on an operation by a user, the actual direction of movement being a direction in which the watercraft actually moves, and the actual speed being a speed at which the watercraft actually moves, wherein the display has a direction-of-movement indicator that is controlled by the display controller to show an indication related to a direction of movement of the watercraft, and the direction-of-movement indicator shows the indication in a first mode and a second mode, the first mode being a display mode displaying that there is a disagreement between the specified direction of movement and the actual direction of movement, the second mode being a display mode displaying that there is an agreement between the specified direction of movement and the actual direction of movement.

2. The display device according to claim 1, wherein the direction-of-movement indicator shows the indication further in a third mode which is a display mode displaying that there is an agreement between a specified speed based on an operation by the user and the actual speed.

3. The display device according to claim 2, wherein in the first mode, the direction-of-movement indicator blinks, in the second mode, the direction-of-movement indicator blinks in a longer cycle than in the first mode, and in the third mode, the direction-of-movement indicator is steadily on without blinking.

4. The display device according to claim 3, wherein a cycle in which the direction-of-movement indicator blinks in the first mode changes in accordance with a degree of disagreement between the specified direction of movement and the actual direction of movement, and approaches a cycle in which the direction-of-movement indicator blinks in the second mode as the specified direction of movement and the actual direction of movement approach agreement.

5. The display device according to claim 3, wherein brightness of the direction-of-movement indicator is higher in the second mode than in the first mode, and is higher in the third mode than in the second mode.

6. The display device according to claim 2, wherein the direction-of-movement indicator includes a forward indicator to indicate moving forward and a reverse indicator to indicate moving in reverse, in the first mode, the forward indicator and the reverse indicator both blink, and one of the forward indicator and the reverse indicator that corresponds to the specified direction of movement is displayed brighter than an other that does not correspond to the specified direction of movement, in the second mode, only one of the forward indicator and the reverse indicator that corresponds to the specified direction of movement blinks, and in the third mode, only one of the forward indicator and the reverse indicator that corresponds to the specified direction of movement is steadily on without blinking.

7. An outboard motor mountable on a watercraft, the outboard motor comprising:

a thruster:

a prime mover that rotates the thruster:

a direction-of-movement specifier that specifies a direction in which the watercraft is to move as a specified direction of movement;

a controller that controls a rotation direction of the thruster based on the specified direction of movement, receives information of a detected direction in which the watercraft actually moves as an actual direction of movement, and receives information of a detected speed at which the watercraft actually moves as an actual speed; and a direction-of-movement indicator that shows an indication related to a direction of movement of the watercraft, wherein the direction-of-movement indicator shows the indication in a first mode and a second mode, the first mode being a display mode displaying that there is a disagreement between the specified direction of movement and the actual direction of movement, the second mode being a display mode displaying that there is an agreement between the specified direction of movement and the actual direction of movement.

8. A display device for use on a watercraft to display a state of movement of the watercraft on a display, the display device comprising:

a display controller that controls indication on the display, wherein the display controller acquires a specified direction of movement, an actual direction of movement, and an actual speed, the specified direction of movement being a specified direction in which the watercraft is to move in accordance with an instruction based on an operation by a user, the actual direction of movement being a direction in which the watercraft actually moves, and the actual speed being a speed at which the watercraft actually moves, wherein the display has a direction-of-movement indicator that is controlled by the display controller to show an indication related to a direction of movement of the watercraft, and the direction-of-movement indicator shows the indication in a first mode, a second mode, and a third mode, the first mode being a display mode displaying that there is a disagreement between the specified direction of movement and the actual direction of movement, the second mode being a display mode displaying that there is an agreement between the specified direction of movement and the actual direction of movement, and the third mode being a display mode displaying that there is an agreement between a specified speed acquired based on an operation by the user and the actual speed.

9. The display device according to claim 8, wherein in the first mode, the direction-of-movement indicator blinks, in the second mode, the direction-of-movement indicator blinks in a longer cycle than in the first mode, and in the third mode, the direction-of-movement indicator is steadily on without blinking.

10. The display device according to claim 9, wherein a cycle in which the direction-of-movement indicator blinks in the first mode changes in accordance with a degree of disagreement between the specified direction of movement and the actual direction of movement, and approaches a cycle in which the direction-of-movement indicator blinks in the second mode as the specified direction of movement and the actual direction of movement approach agreement.

11. The display device according to claim 9, wherein brightness of the direction-of-movement indicator is higher in the second mode than in the first mode, and is higher in the third mode than in the second mode.

12. The display device according to claim 8, wherein the direction-of-movement indicator includes a forward indicator to indicate moving forward and a reverse indicator to indicate moving in reverse, in the first mode, the forward indicator and the reverse indicator both blink, and one of the forward indicator and the reverse indicator that corresponds to the specified direction of movement is displayed brighter than an other that does not correspond to the specified direction of movement, in the second mode, only one of the forward Indicator and the reverse indicator that corresponds to the specified direction of movement blinks, and in the third mode, only one of the forward Indicator and the reverse indicator that corresponds to the specified direction of movement is steadily on without blinking.

* * * * *